US009534742B2

(12) United States Patent
Hsu et al.

(10) Patent No.: US 9,534,742 B2
(45) Date of Patent: Jan. 3, 2017

(54) LIGHT BAR STRUCTURE

(71) Applicant: LEXTAR ELECTRONICS CORPORATION, Hsinchu (TW)

(72) Inventors: Chin-Chang Hsu, Pingtung County (TW); Chang-Lin Yu, Chiayi County (TW)

(73) Assignee: Lextar Electronics Corporation, Hsinchu (TW)

( * ) Notice: Subject to any disclaimer, the term of this patent is extended or adjusted under 35 U.S.C. 154(b) by 0 days.

(21) Appl. No.: 14/201,243

(22) Filed: Mar. 7, 2014

(65) Prior Publication Data

US 2015/0062887 A1 Mar. 5, 2015

(30) Foreign Application Priority Data

Aug. 28, 2013 (TW) ..... 102130755 A

(51) Int. Cl.

| | |
|---|---|
| ***F21V 23/00*** | (2015.01) |
| ***F21V 23/02*** | (2006.01) |
| ***F21K 99/00*** | (2016.01) |
| *F21Y 101/00* | (2016.01) |

(52) U.S. Cl.

CPC . *F21K 9/30* (2013.01); *F21K 9/20* (2016.08); *F21S 4/28* (2016.01); *F21V 23/005* (2013.01); *F21V 23/02* (2013.01); *F21V 23/026* (2013.01); *F21Y 2101/00* (2013.01); *F21Y 2103/10* (2016.08); *F21Y 2115/10* (2016.08)

(58) Field of Classification Search

CPC ..... F21K 9/30; F21S 4/008; F21V 23/02; F21V 23/026; F21Y 2101/00; F21Y 2103/00

USPC ..... 362/217.17

See application file for complete search history.

(56) References Cited

U.S. PATENT DOCUMENTS

| | | | | |
|---|---|---|---|---|
| 5,008,788 | A | 4/1991 | Palinkas | |
| 7,771,107 | B2 | 8/2010 | Lung | |
| 7,888,695 | B2 | 2/2011 | Lin et al. | |
| 8,132,935 | B2 * | 3/2012 | Park et al. | 362/235 |
| 8,783,899 | B2 * | 7/2014 | Tsai et al. | 362/225 |
| 2006/0035511 | A1 * | 2/2006 | Mrakovich | F21S 4/10 439/404 |
| 2007/0298645 | A1 * | 12/2007 | Ohtsuki | H01R 9/096 439/331 |
| 2010/0157593 | A1 * | 6/2010 | Zhou et al. | 362/235 |
| 2015/0159815 | A1 | 6/2015 | Hsu | |

FOREIGN PATENT DOCUMENTS

| | | |
|---|---|---|
| TW | M376707 U | 3/2010 |
| TW | M394409 U1 | 12/2010 |
| TW | M422638 U1 | 2/2012 |

* cited by examiner

*Primary Examiner* — Sharon Payne

(57) ABSTRACT

A light bar structure is provided, including a longitudinal circuit board, a plurality of light-emitting elements, and a power-input terminal. The circuit board includes a first segment, a second segment, and a third segment arranged along a longitudinal axis of the circuit board, wherein the second segment is between the first segment and the third segment. The light-emitting elements are disposed on the circuit board. The power-input terminal is disposed on the second segment and electrically connected to the light-emitting elements in parallel.

16 Claims, 2 Drawing Sheets

LIGHT BAR STRUCTURE

CROSS REFERENCE TO RELATED APPLICATIONS

The present application claims priority of Taiwan Patent Application No. 102130755, filed on Aug. 28, 2013, the entirety of which is incorporated by reference herein.

BACKGROUND OF THE INVENTION

Field of the Invention

The present application is about a light bar structure that including light-emitting diodes with parallel connected in particular.

Description of the Related Art

A light-emitting diode (LED) is a semiconductor light source which has many advantages over conventional light sources including higher illumination, lower energy consumption, longer lifetime, improved physical robustness, faster switching, and greater reliability. Thus, it is generally used for lighting and backlighting.

One common application type of the LED is a light bar structure which includes a longitudinal circuit board with a plurality of light-emitting diodes disposed thereon, wherein the light-emitting diodes are arranged along a longitudinal axis of the circuit board. In addition, a power signal is applied to the light-emitting diodes from one end of the circuit board. However, this structure may cause non-uniformity of the current or voltage signal applying to the light-emitting diodes due to the impedance of the circuit board and the wires thereon, thus cause non-uniform illumination of the light-emitting diodes.

BRIEF SUMMARY OF THE INVENTION

An embodiment of the invention provides a light bar structure, comprising a longitudinal circuit board, a plurality of light-emitting elements, and a power-input terminal. The circuit board includes a first segment, a second segment, and a third segment arranged along a longitudinal axis of the circuit board, wherein the second segment is between the first segment and the third segment. The light-emitting elements are disposed on the circuit board. The power-input terminal is disposed on the second segment and electrically connected to the light-emitting elements in parallel.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

Figure 1:
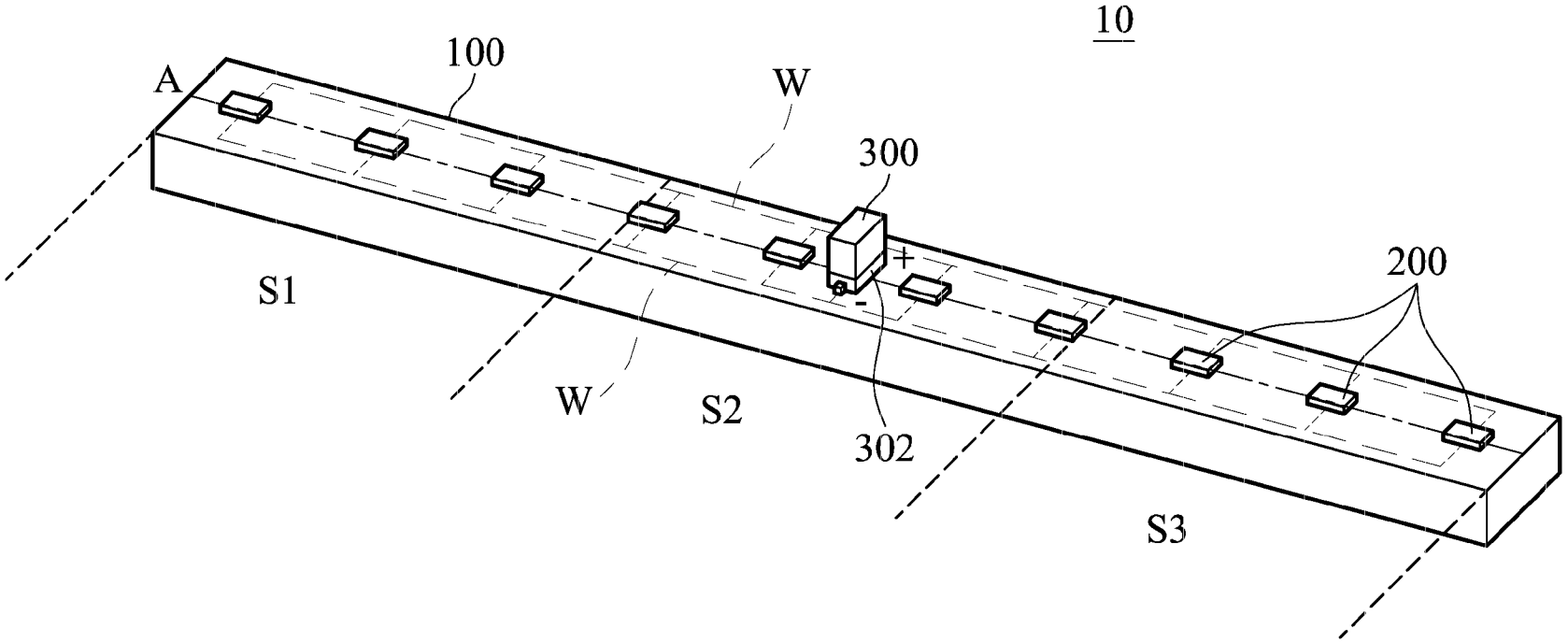
FIG. 1 is a perspective diagram of a light bar structure according to an embodiment of the invention.

Referring to FIG. 1, the major part of a light bar structure 10 according to an embodiment of this invention includes a longitudinal circuit board 100 and a plurality of light-emitting elements 200 disposed thereon. The light bar structure 10 may be applied to an illumination or backlight module.

In this embodiment, the circuit board 100 may be a printed circuit board, and the light-emitting elements 200 may be light-emitting diodes disposed on the circuit board 100 by Surface mount technology (SMT). In some embodiments, the light-emitting elements 200 may be other electroluminescent light sources.

As shown in FIG. 1, the circuit board 100 includes a first segment S1, a second segment S2, and a third segment S3 having substantially the same dimensions and arranged along a longitudinal axis A of the circuit board 100. In this embodiment, the first, second, and third segments S1, S2, and S3 are integrally formed in one piece. The light-emitting elements 200 are arranged along the longitudinal axis A in a line and separated from each other by a specific distance.

In addition, there are multiple wires W disposed on the surface of the circuit board 100, wherein an insulating layer (not shown in FIG. 1) may be applied for protecting the wires W. A power-input terminal 300 is disposed on the second segment S2 and may be a power supply itself or electrically connected to an external power supply. The power-input terminal 300 is electrically connected to the light-emitting elements 200 in parallel through the wires W, so as to provide the driving electric-energy for light-emitting elements 200.

Note that the power-input terminal 300 of this embodiment is disposed on the second segment S2 of the circuit board 100, which is between the first and third segments S1 and S3. In other words, the power-input terminal 300 is located in a range from one-third to two-thirds of the longitudinal axis A of the circuit board 100. Owing to the power-input terminal 300 being located in a relative middle position of the circuit board 100, the distances from the power-input terminal 300 to the light-emitting elements 200 at the two ends of the circuit board 100 can be balanced. Accordingly, the deficiency of non-uniformity of the driving electric-energy applying to the light-emitting elements 200 due to the impedance of the circuit board 100 and the wires W thereon can be improved, thus achieving uniform illumination of the parallel light-emitting elements 200.

Figure 2:
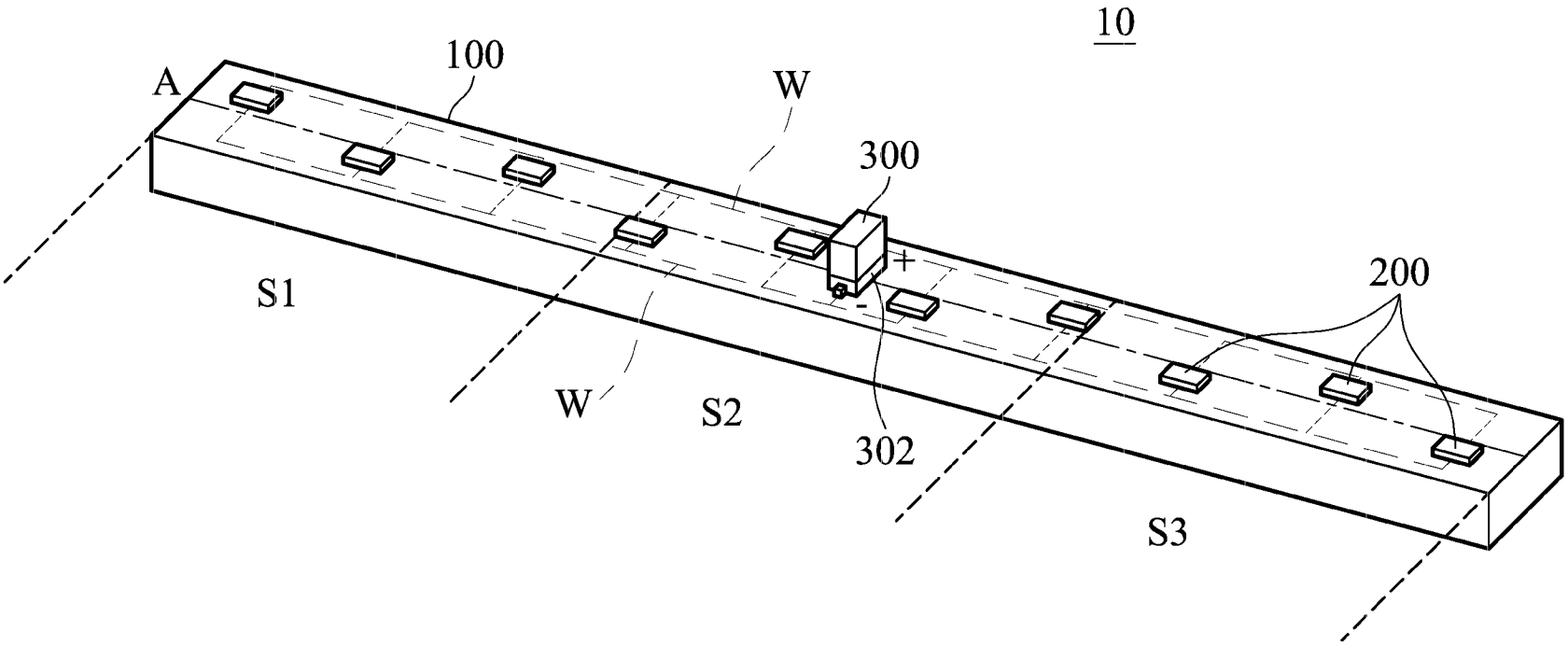
FIG. 2 is a perspective diagram of a light bar structure according to another embodiment of the invention.

FIG. 2 schematically shows another embodiment of a light bar structure 10 which differs from the light bar structure 10 of the aforementioned embodiment (FIG. 1). In FIG. 2, the light-emitting elements 200 are arranged along the longitudinal axis A in a staggered manner, i.e. the adjacent light-emitting elements 200 are disposed on opposite sides of the longitudinal axis A (central axis).

As shown in FIGS. 1 and 2, the power-input terminal 300 includes a connector 302. The power-input terminal 300 may be electrically connected to the circuit board 100 through the pins of the connector 302. In some embodiments, the connector 302 may be connected to the circuit board 100 by soldering.

As mentioned above, the invention provides a light bar structure, including a longitudinal circuit board, a plurality of light-emitting elements, and a power-input terminal. The light-emitting elements are electrically connected to each other in parallel and arranged along the longitudinal axis of the circuit board. The power-input terminal is located in a relative middle position of the circuit board. According to the aforesaid structural features, the deficiency of non-uniformity of the driving electric-energy applying to the light-emitting elements due to the impedance of the circuit board and the wires thereon can be improved. Therefore, uniform illumination of the light-emitting elements on the circuit board can be achieved.

While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A light bar structure, comprising:

a longitudinal circuit board, comprising a first segment, a second segment, and a third segment arranged along a longitudinal axis of the circuit board, wherein the second segment is between the first segment and the third segment, and wherein the first segment, the second segment, and the third segment have substantially the same dimensions and are integrally formed in one piece;

a plurality of light-emitting elements, disposed on the first segment, the second segment, and the third segment of the circuit board;

a plurality of wires disposed on the first segment, the second segment, and the third segment of the circuit board, connecting the plurality of light-emitting elements in parallel; and a single power-input terminal, disposed in a middle position of the second segment of the circuit board and electrically connected to the plurality of light-emitting elements in parallel through the wires so as to provide electric energy to the plurality of light-emitting elements.

2. A light bar structure, comprising:

a longitudinal circuit board, comprising a first segment, a second segment, and a third segment arranged along a longitudinal axis of the circuit board, wherein the second segment is between the first segment and the third segment, and wherein the first segment, the second segment, and the third segment have substantially the same dimensions and are integrally formed in one piece;

a plurality of light-emitting elements, disposed on the first segment, the second segment, and the third segment of the circuit board;

a plurality of wires disposed on the first segment, the second segment, and the third segment of the circuit board, connecting the plurality of light-emitting elements in parallel; and a single power-input terminal electrically connected to the light-emitting elements through the wires in parallel so as to provide electric energy to the plurality of light-emitting elements, wherein the power-input terminal is located in a range from one-third to two-thirds of the longitudinal axis of the circuit board.

3. The light bar structure as claimed in claim 1, wherein the light-emitting elements are arranged along the longitudinal axis in a line.

4. The light bar structure as claimed in claim 1, wherein the light-emitting elements are arranged along the longitudinal axis in a staggered manner.

5. The light bar structure as claimed in claim 1, wherein the light-emitting elements are separated from each other by a distance.

6. The light bar structure as claimed in claim 1, wherein the light-emitting elements are light-emitting diodes.

7. The light bar structure as claimed in claim 1, wherein the power-input terminal includes a connector electrically connected to the circuit board.

8. The light bar structure as claimed in claim 7, wherein the connector is connected to the circuit board by soldering.

9. The light bar structure as claimed in claim 1, wherein the power-input terminal supplies power to all of the plurality of light-emitting elements disposed on the circuit board.

10. The light bar structure as claimed in claim 2, wherein the power-input terminal supplies power to all of the plurality of light-emitting elements disposed on the circuit board.

11. The light bar structure as claimed in claim 2, wherein the light-emitting elements are arranged along the longitudinal axis in a line.

12. The light bar structure as claimed in claim 2, wherein the light-emitting elements are arranged along the longitudinal axis in a staggered manner.

13. The light bar structure as claimed in claim 2, wherein the light-emitting elements are separated from each other by a distance.

14. The light bar structure as claimed in claim 2, wherein the light-emitting elements are light-emitting diodes.

15. The light bar structure as claimed in claim 2, wherein the power-input terminal includes a connector electrically connected to the circuit board.

16. The light bar structure as claimed in claim 15, wherein the connector is connected to the circuit board by soldering.

* * * * *